US010753089B2

(12) United States Patent
Downey et al.

(10) Patent No.: US 10,753,089 B2
(45) Date of Patent: Aug. 25, 2020

(54) CEILING ISOLATION HANGER AND FLOATING CEILING CONSTRUCTION EMPLOYING SAME

(71) Applicant: Pliteq Inc., Vaughan (CA)

(72) Inventors: Paul Downey, Vaughan (CA); Mathew Golden, Vaughan (CA); Wilson Byrick, Vaughan (CA)

(73) Assignee: Pliteq Inc. (CA)

( * ) Notice: Subject to any disclaimer, the term of this patent is extended or adjusted under 35 U.S.C. 154(b) by 0 days.

(21) Appl. No.: 15/719,819

(22) Filed: Sep. 29, 2017

(65) Prior Publication Data

US 2018/0238052 A1 Aug. 23, 2018

Related U.S. Application Data

(60) Provisional application No. 62/402,410, filed on Sep. 30, 2016.

(51) Int. Cl.

| | |
|---|---|
| ***E04B 9/18*** | (2006.01) |
| ***E04B 9/00*** | (2006.01) |
| *E04B 1/82* | (2006.01) |

(52) U.S. Cl.

CPC ..... *E04B 9/183* (2013.01); *E04B 9/001* (2013.01); *E04B 2001/8263* (2013.01); *E04B 2009/186* (2013.01)

(58) Field of Classification Search

CPC . E04B 9/13; E04B 9/001; E04B 9/183; E04B 2001/8263; E04B 2009/186

See application file for complete search history.

(56) References Cited

U.S. PATENT DOCUMENTS 1,778,412 A * 10/1930 Balduf ..... E04B 9/001 52/402
1,935,536 A * 11/1933 Balduf ..... E04B 2/56 52/346
1,963,609 A * 6/1934 Balduf ..... E04B 1/7654 52/405.4
1,982,565 A * 11/1934 Barge ..... E04B 9/18 248/613
2,026,117 A * 12/1935 Balduf ..... E04F 13/045 52/346
2,041,773 A * 5/1936 Manske ..... E04F 13/045 52/346
3,241,280 A * 3/1966 Kreuzer ..... E04B 9/001 52/144
3,861,105 A * 1/1975 Starks ..... E04B 9/18 248/317
3,998,419 A * 12/1976 Semmerling ..... E04B 9/18 248/323
4,358,216 A * 11/1982 Pleickhardt ..... F16B 2/245 403/387
4,630,423 A * 12/1986 Lind ..... E04B 9/122 248/224.8

(Continued)

*Primary Examiner* — Paola Agudelo
(74) *Attorney, Agent, or Firm* — Fay Sharpe LLP

(57) ABSTRACT

A ceiling isolation hanger comprises a bracket configured to be secured to an overhead mounting surface. The bracket comprises vibration dampening material configured to bear against the mounting surface, a clip configured to engage and retain a furring channel beneath the mounting surface, and at least one spring element extending between the bracket and the clip.

27 Claims, 8 Drawing Sheets

(56) References Cited

U.S. PATENT DOCUMENTS

| | | | | | |
|---|---|---|---|---|---|
| 5,146,724 | A * | 9/1992 | Angelo | F16B 2/02 | 248/228.1 |
| 5,355,646 | A * | 10/1994 | Bischel | E04B 9/16 | 24/563 |
| 5,428,930 | A * | 7/1995 | Bagley | E04B 9/003 | 52/483.1 |
| 6,178,705 | B1 * | 1/2001 | Lefebvre | E04B 1/84 | 52/144 |
| 6,287,064 | B1 * | 9/2001 | Jhumra | F16B 37/043 | 411/112 |
| 9,004,422 | B2 * | 4/2015 | Feenstra | A62C 35/68 | 248/200.1 |
| 9,976,303 | B2 * | 5/2018 | Gloftis | E04B 9/245 | |
| 2007/0294972 | A1 * | 12/2007 | Ducharme | G10K 11/16 | 52/351 |
| 2008/0086966 | A1 * | 4/2008 | Stevens | E04B 1/84 | 52/347 |
| 2009/0242726 | A1 * | 10/2009 | Carels | E04B 1/82 | 248/562 |
| 2010/0251652 | A1 * | 10/2010 | Golden | E04B 9/18 | 52/489.1 |
| 2011/0016816 | A1 * | 1/2011 | Lizarazu | E04B 9/183 | 52/411 |
| 2017/0044767 | A1 * | 2/2017 | Gloftis | E04B 9/183 | |

* cited by examiner

CEILING ISOLATION HANGER AND FLOATING CEILING CONSTRUCTION EMPLOYING SAME

CROSS REFERENCE TO RELATED APPLICATION

This application claims the benefit of U.S. Provisional Application No. 62/402,410 filed on Sep. 30, 2016 entitled "CEILING ISOLATION HANGER AND FLOATING CEILING CONSTRUCTION EMPLOYING SAME" to Downey et al., the entire contents of which are incorporated herein by reference.

FIELD

The subject application relates to noise and vibration control and in particular, to a ceiling isolation hanger and a floating ceiling construction employing the same.

BACKGROUND

Insulating building structures to inhibit the transmission of vibration and noise from one region to another is common in many environments. For example, vibration dampening pads, mats and tiles for use on floors to inhibit vibration/noise from traveling through floor surfaces are well known.

In many building applications, furring channels are used to attach one part of a building structure, for example wallboard or other sheet material, to another part of the building structure. Noise, transmitted structurally as vibration, is often transmitted from one part of the building to another through the furring channel connection points.

When hanging a ceiling from a structure, furring channels are typically attached to the ceiling joists, and ceiling panels are then hung from the furring channels. In order to reduce noise and vibration transferred via these connections, vibration isolating mounting methods have been employed. For example, mounting clips for mounting standard furring channels to ceiling joist surfaces such that ceiling panels secured to the furring channels are vibrationally isolated from the ceiling joist surfaces have been considered. These clips unfortunately can be expensive to manufacture and in some cases only provide minimal vibration isolation.

Other vibration isolating methods have been considered. For example, U.S. Pat. No. 8,549,809 to Golden et al. discloses a vibration isolating mounting clip in the form of a bent metal strip, which is used to mount a furring channel to a mounting surface. The resilient bent metal strip has a first end and an opposing second end, and a transition portion shaped to fit the furring channel. The resilient bent metal strip has a stiffness and shape such that when the furring channel is positioned in the resilient bent metal strip, the resilient bent metal strip is mounted to the mounting surface, and a finishing substrate is loaded on the furring channel, the furring channel does not contact the mounting surface. Between the ends of the resilient bent metal strip, and the furring channel, are one to several bends, towards and away from the mounting surface to achieve the desired resiliency.

Although various techniques for vibrationally isolating furring channels from ceiling joist surfaces have been considered, improvements are desired. It is therefore an object to provide a novel ceiling isolation hanger and floating ceiling construction employing the same.

SUMMARY

Accordingly, in one aspect there is provided a ceiling isolation hanger comprising: a bracket configured to be secured to an overhead mounting surface, the bracket comprising vibration dampening material configured to bear against the mounting surface; a clip configured to engage and retain a furring channel beneath the mounting surface; and at least one spring element extending between the bracket and the clip.

In one or more embodiments, the bracket is configured to be secured to one of a side surface and a bottom surface of a ceiling joist or to an undersurface of an overhead ceiling.

In one or more embodiments, the vibration dampening material is molded onto the bracket.

In one or more embodiments, the vibration dampening material comprises elastomeric or viscoelastic material.

In one or more embodiments, the at least one spring member has one of a curved, triangular and accordion configuration.

In one or more embodiments, the clip comprises a plurality of channels configured to receive flanges of the furring channel.

In one or more embodiments, the bracket, the clip and the at least one spring element are formed of metal.

In one or more embodiments, the at least one spring element is configured to deflect 0.1" to 1.0" under ceiling load.

According to another aspect, there is provided a ceiling construction comprising a plurality of ceiling isolation hangers secured to an overhead mounting surface at spaced locations and arranged in aligned rows; furring channels retained by the clips of the ceiling isolation hangers of each aligned row; and ceiling panels secured to the furring channels.

According to another aspect, there is provided a ceiling isolation hanger comprising a securing element configured to be secured to a ceiling joist and comprising vibration dampening material to bear against a ceiling joist surface; a furring channel retaining element configured to retain a furring channel beneath the ceiling joist; and one or more spring elements extending between the securing element and the furring channel retaining element.

According to another aspect, there is provided a ceiling construction comprising: a plurality of ceiling isolation hangers according to paragraph [0016] secured to the overhead mounting surface at spaced locations and arranged in aligned rows; furring channels retained by the furring channel retaining elements of the ceiling isolation hangers of each aligned row; and ceiling panels secured to the furring channels.

BRIEF DESCRIPTION OF DRAWINGS

Embodiments will now be described more fully with reference to the accompany drawings in which.

DETAILED DESCRIPTION OF EMBODIMENTS

Figure 1:
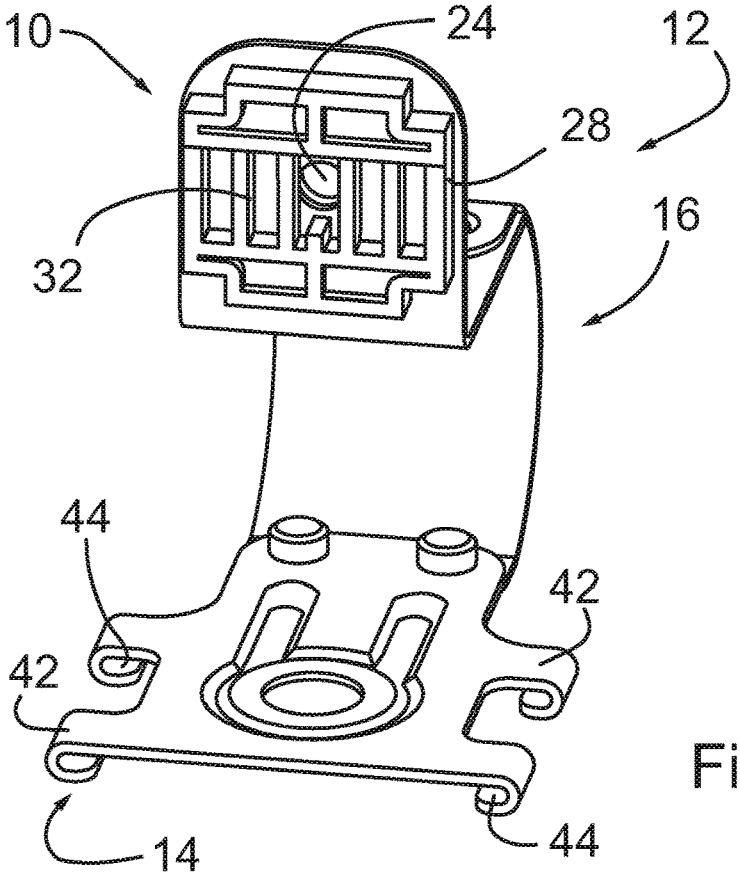
FIG. 1 is an isometric view of a ceiling isolation hanger.

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings. It will also be appreciated that like reference characters will be used to refer to like elements throughout the description and drawings.

In the following, various embodiments of a ceiling isolation hanger are shown and described. Broadly, the ceiling isolation hanger comprises a bracket or securing element configured to be secured to an overhead mounting surface such as a ceiling joist surface or an overhead ceiling. The bracket or securing element comprises vibration dampening material configured to bear against the mounting surface to isolate the bracket or securing element from mounting surface vibration. A clip or furring channel retaining element is configured to engage and retain a furring channel beneath the mounting surface. One or more spring elements extend between the bracket or securing element and the clip or furring channel retaining element. Particular non-limiting examples of ceiling isolation hangers and ceiling constructions employing the ceiling isolation hangers will now be described.

Figure 2:
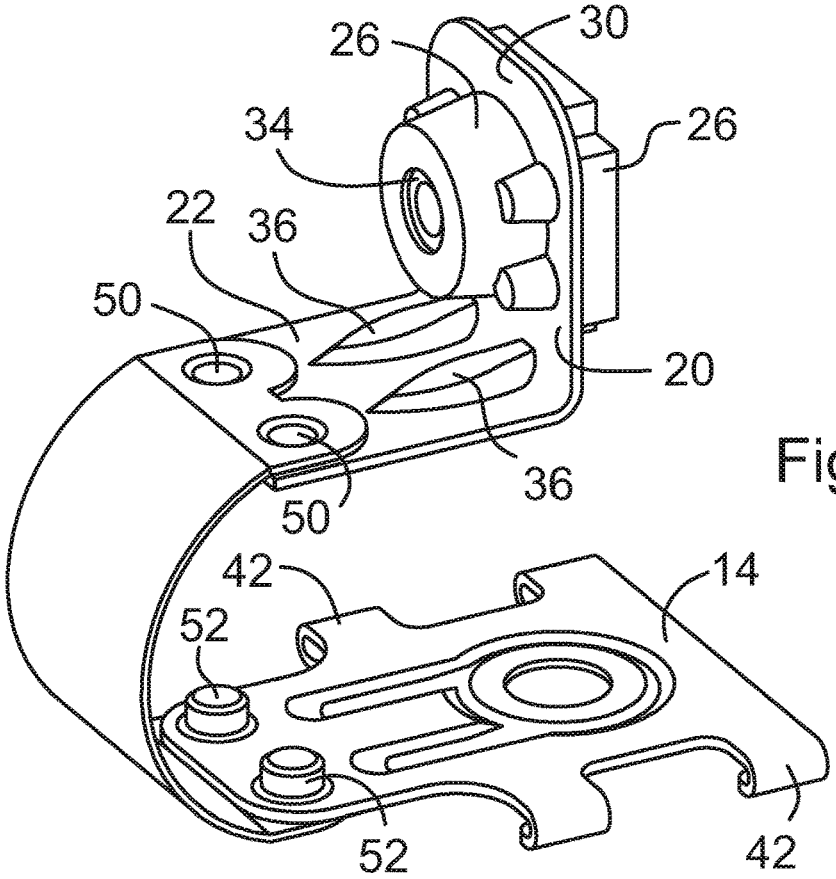
FIG. 2 is another isometric view of the ceiling isolation hanger of FIG. 1.

Turning now to FIGS. 1 and 2, a ceiling isolation hanger for mounting a furring channel to a mounting surface such as a ceiling joist is shown and is generally identified by reference numeral 10. The ceiling isolation hanger 10 comprises a bracket 12 configured to be secured to the side surface of a ceiling joist, a clip 14 configured to engage and retain a furring channel beneath the ceiling joist and a spring element 16 extending between the bracket 12 and the clip 14.

In this embodiment, the bracket 12 is formed of metal such as steel and comprises a pair of arms 20 and 22 arranged at approximately right angles giving the bracket 12 an L-shape. Arm 20 of the bracket 12 has a central aperture 24 provided through it. Vibration dampening material 26 lines the aperture 24 and extends over a portion of both major surfaces 28 and 30 of the arm 20. The vibration dampening material 26 may be elastomeric or viscoelastic material such as polyurethane bonded recycled rubber, polyether urethane foam or other suitable energy absorbing material. On major surface 28 of the arm 20, the vibration dampening material 26 is configured to define a plurality of spaced ribs 32. On the major surface 30 of the arm, the vibration dampening material 26 is configured to retain a washer 34 generally in alignment with the central aperture 24. The vibration dampening material 26 is injection molded onto the bracket 12. Arm 22 of the bracket 12 has a pair of spaced triangular reinforcement ribs 36 formed in it, which extend to arm 20. A pair of spaced wells (not shown) are also formed in the arm 22 adjacent its distal end.

The clip 14 in this embodiment is also formed of metal such as steel and is in the form of a generally rectangular plate member having laterally spaced legs 42 extending from its opposite sides. The legs 42 are folded back under themselves to define channels 44 configured to receive flanges of a furring channel. Wells (not shown) are formed in the clip 14 adjacent one of its ends.

The spring element 16 in this embodiment is formed of metal such as steel and has a curved configuration. Spaced dimples 50 are formed in the spring element 16 adjacent its opposite ends and have shapes complimentary to the wells. The dimples 50 at one end of the spring element 16 are received in the wells formed in arm 22 and the dimples at the other end of the spring element 16 are received in the wells formed in the clip 14. Fasteners 52 in the form of rivets pass through spring element 16 and arm 22 at the wells to secure the spring element 16 to the bracket 12. Fasteners 52 in the form of rivets also pass through spring element 16 and clip 14 at the wells to secure the spring element 16 to the clip 14.

Figure 3:
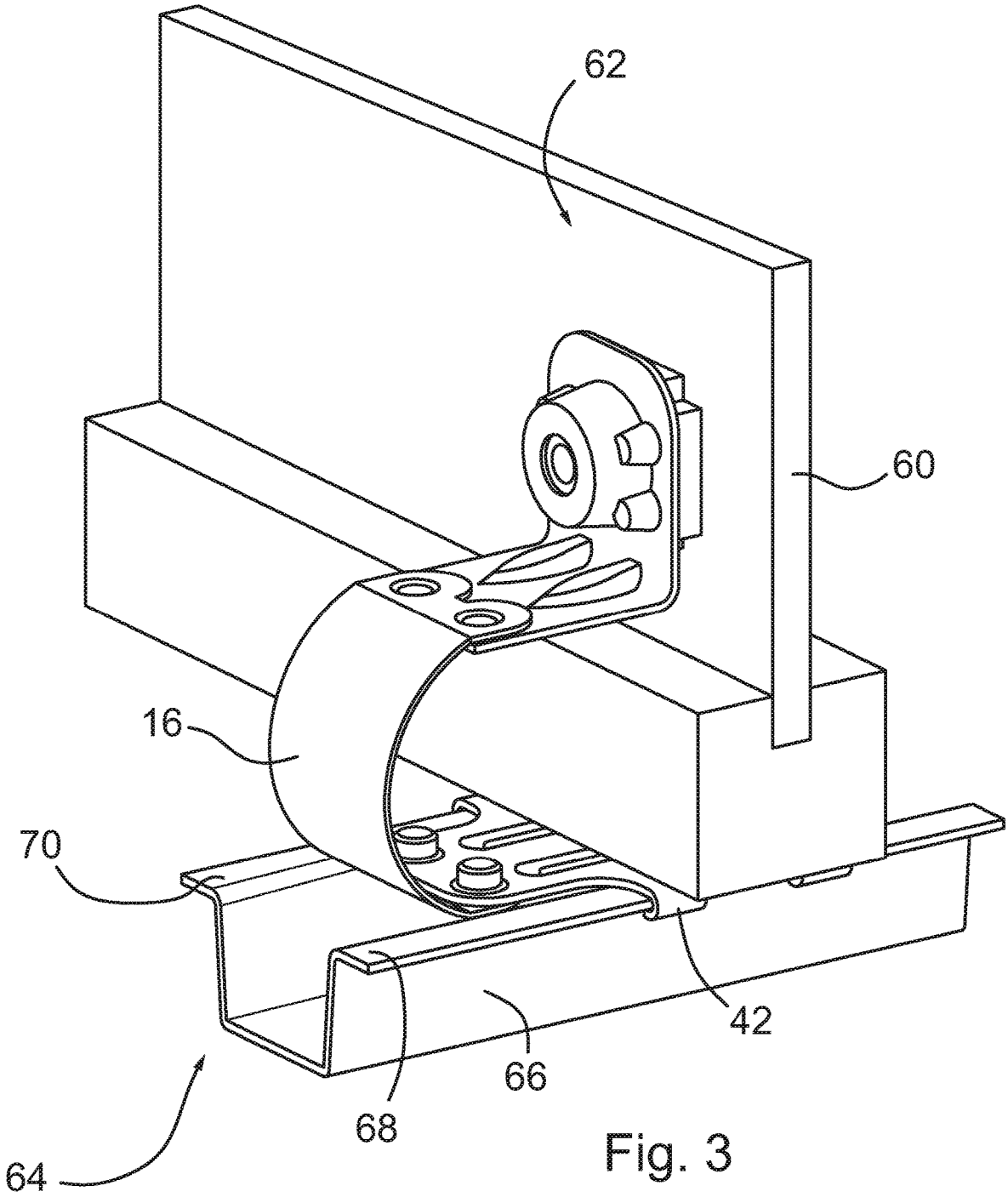
FIG. 3 is an isometric view of the ceiling isolation hanger of FIG. 1 secured to a ceiling joist.

Turning now to FIG. 3, during installation of the ceiling isolation hanger 10, the bracket 12 is positioned so that the ribs 32 of the vibration damping material 26 bear against the side surface 62 of a ceiling joist 60 and so that the spring element 16 supports the clip 14 beneath the ceiling joist 60. A fastener (not shown) such as a screw is then passed through the aligned apertures of the washer 34 and arm 20 to engage the ceiling joist 60 and secure the ceiling isolation hanger 10 to the ceiling joist. A standard furring channel 64 comprising a channel portion 66 and flanges 68 and 70 can then be connected to the clip 14 by inserting the flanges 68 and 70 into the channels 44 defined by the legs 42 thereby to engage and retain the furring channel 64.

Figure 4:
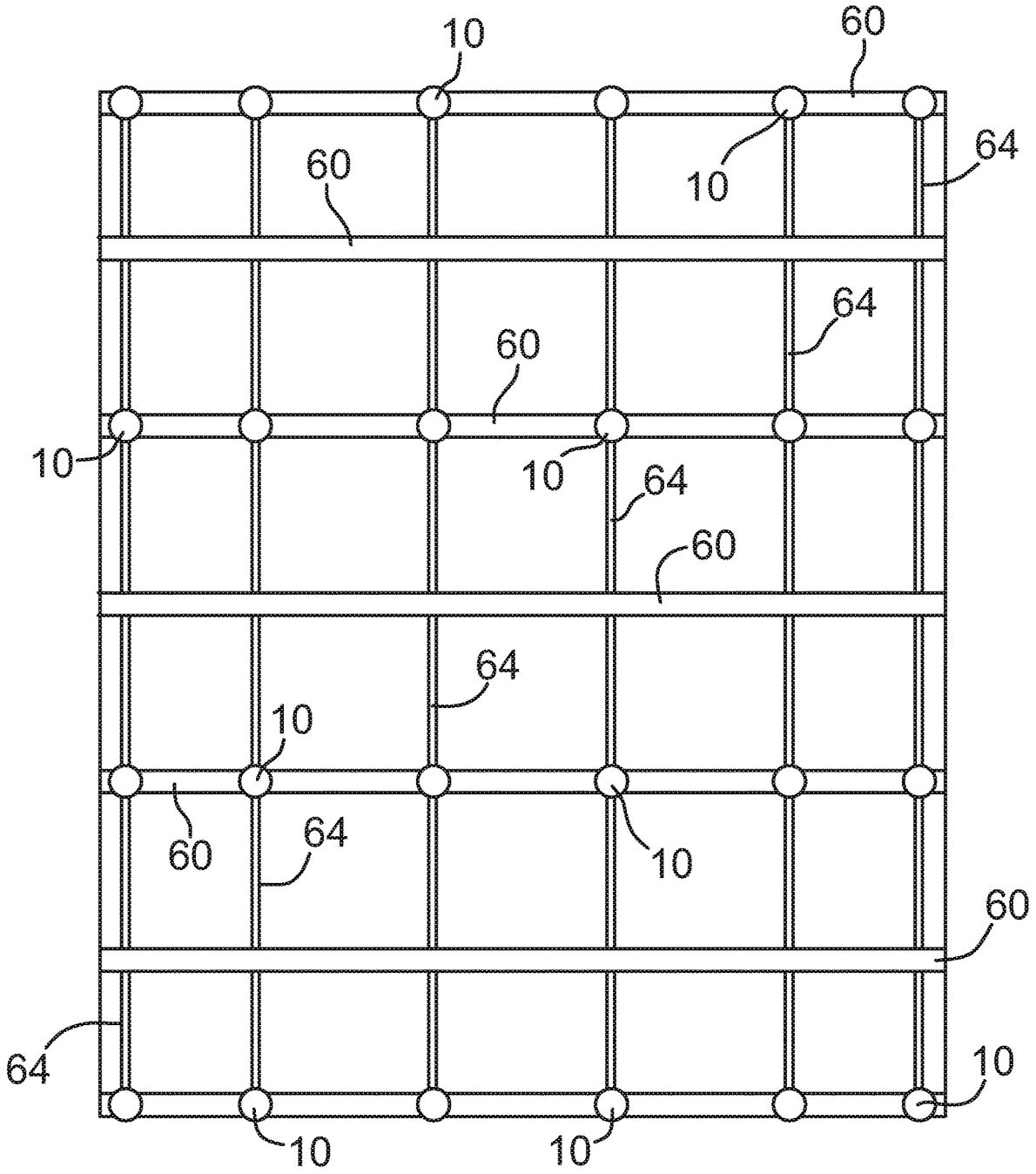
FIG. 4 is a plan view of a ceiling structure comprising ceiling joists, ceiling isolation hangers secured to every other ceiling joist at spaced locations and arranged in aligned rows and furring channels retained by the aligned rows of ceiling isolation hangers.

In a typical floating ceiling construction as shown in FIG. 4, ceiling isolation hangers 10 designated by circles are secured to ceiling joists 60 at spaced locations along their lengths and are arranged in aligned rows. In the example shown, the ceiling isolation hangers 10 are secured to every other ceiling joist 60, although those of skill in the art will appreciate that ceiling isolation hangers 10 may be secured to ceiling joists 60 in different patterns. With the ceiling isolation hangers 10 secured to the ceiling joists 60, furring channels 64 extending orthogonal to the ceiling joists 60 are connected to the clips 14 of the aligned ceiling isolation hangers 10. Ceiling panels (not shown) are then be secured to the channel portions 66 of the furring channels 64 using fasteners that pass through the ceiling panels and engage the channel portions 66 of the furring channels 64 to complete the floating ceiling.

The spring element 16 of each ceiling isolation hanger 10 in this embodiment is designed to deflect 0.1" under the load of the ceiling. In this manner, the ceiling is spaced from and floats under the ceiling joists 60. This arrangement in conjunction with the vibration dampening material 26 acting between arms 20 of the brackets 12 and the ceiling joists 60 isolates the ceiling from the ceiling joists and thus, inhibits vibration in the ceiling joists 60 from being transmitted to the furring channels 64 and ceiling. In the above floating ceiling construction, because the brackets 12 are secured to the sides 62 of the ceiling joists 60, the vertical positions of the ceiling isolation hangers 10 relative to the ceiling joists can be arranged or oriented to compensate for non-level ceiling joists allowing a level floating ceiling to be constructed even when the ceiling joists are not level.

As those of skill in the art will appreciate, the outer diameter of the washer 34 is greater than the diameter of the central aperture 24 in the arm 20 and the diameter of the head of the fastener is greater than the diameter of the washer 34 to inhibit the bracket 12 from separating from the ceiling joist 60 should the vibration dampening material 26 melt or degrade.

Although the spring element 16 of the ceiling isolation hanger 10 is described as having a curved configuration, those of skill in the art will appreciate that other configurations are possible. For example, the spring element 16 may have a triangular configuration, an accordion configuration or other suitable configuration to suit the particular environment in which the ceiling isolation hanger is installed and to achieve the desired deflection under load. Depending on environment, it may be desired for ceiling isolation hanger to deflect more under the ceiling load. For example, the spring element 16 may be designed to deflect by 0.5", 1.0" or other desired amount under ceiling load. Also depending on the ceiling construction, ceiling isolation hangers having different load deflection characteristics may be employed.

In the above embodiment, although the ceiling isolation hanger is described as having a single spring element 16, those of skill in the art will appreciate that multiple spring elements 16 interconnecting the bracket 12 and clip 14 may be employed.

Figure 5A:
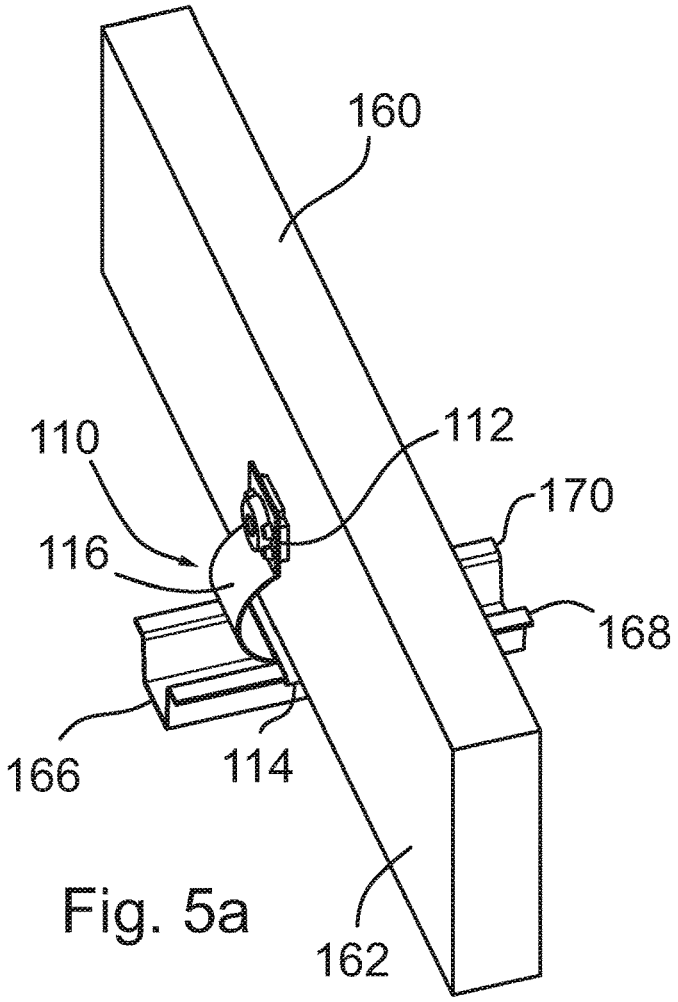
FIGS. 5*a* and 5*b* are isometric views of another embodiment of a ceiling isolation hanger secured to a ceiling joist.
Figure 5B:
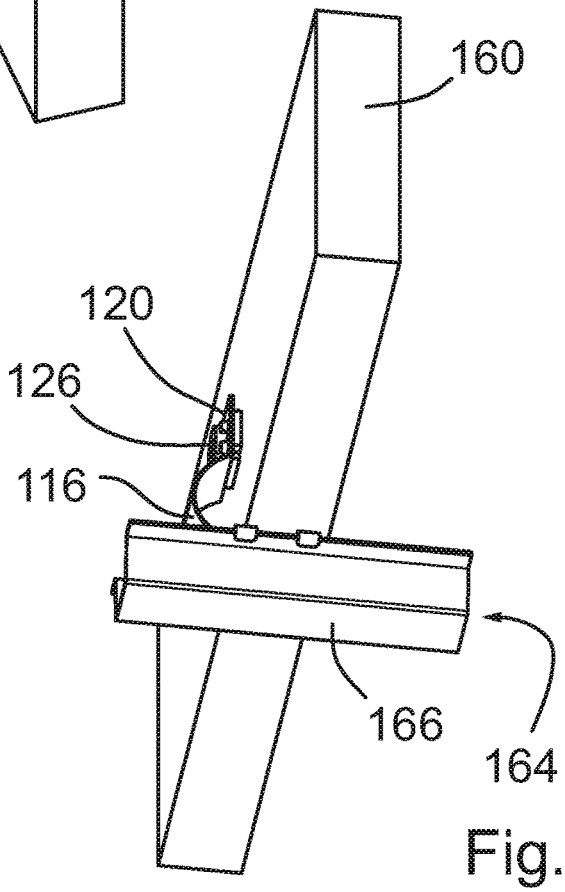

Turning now to FIGS. 5*a* and 5*b*, an alternative ceiling isolation hanger is shown and is generally identified by reference numeral 110. Similar to the previous embodiment, the ceiling isolation hanger 110 comprises a bracket 112 configured to be secured to the side surface of a ceiling joist, a clip 114 configured to engage and retain a furring channel beneath the ceiling joist and a spring element 116 extending between the bracket 112 and the clip 114. Rather than being formed of separate components, in this embodiment, the ceiling isolation hanger 110 is of a one-piece metal construction with the bracket 112, clip 114 and spring element 116 being integrally formed.

The bracket 112 in this embodiment is in the form of a generally rectangular plate member having a central aperture (not shown) provided through it. Similar to the previous embodiment, vibration dampening material 126 lines the aperture and extends over a portion of both major surfaces of the bracket 112. The vibration dampening material 126 is configured to retain a washer (not shown) generally in alignment with the central aperture. The spring element 116 extends from one end of the bracket 112 to the clip 114. The configuration of the clip 114 and the spring element 116 are similar to the previous embodiment.

During installation of the ceiling isolation hanger 110, the bracket 112 is positioned so that the vibration damping material 126 bears against the side surface 162 of a ceiling joist 160 and so that the spring element 116 supports the clip 114 beneath the ceiling joist 160. A fastener (not shown) such as a screw is then passed through the aligned apertures of the washer and bracket 112 to engage the ceiling joist 160 and secure the ceiling isolation hanger 110 to the ceiling joist. A standard furring channel 164 comprising a channel portion 166 and flanges 168 and 170 can then be connected to the clip 114 by inserting the flanges 168 and 170 into the channels defined by the legs of the clip 114 thereby to engage and retain the furring channel 164.

Figure 6A:
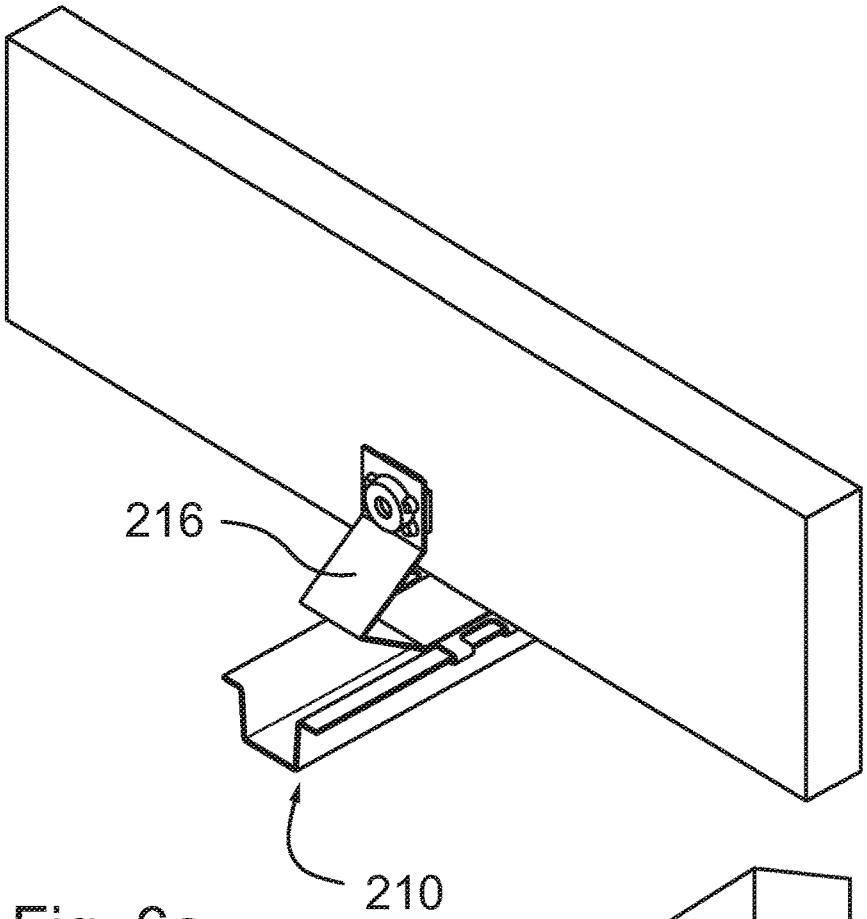
FIGS. 6*a* and 6*b* are isometric views of another embodiment of a ceiling isolation hanger secured to a ceiling joist.
Figure 6B:
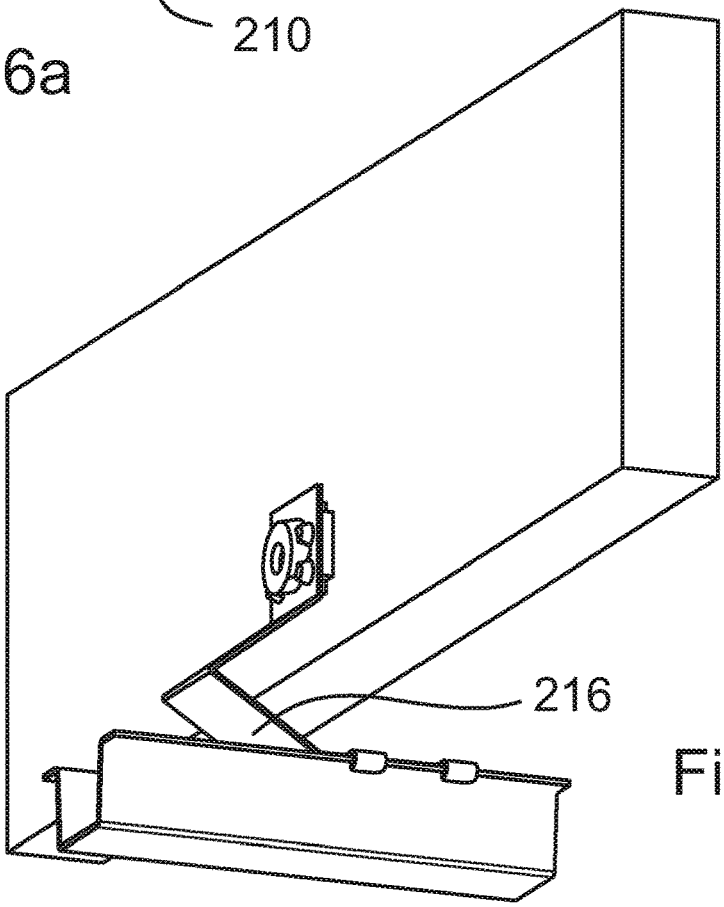

FIGS. 6*a* and 6*b* show another ceiling isolation hanger that is very similar to the ceiling isolation hanger 110 of FIGS. 5*a* and 5*b* and that is generally identified by reference character 210. In this embodiment, rather than having a curved configuration, the spring element 216 has a triangular configuration.

Figure 7A:
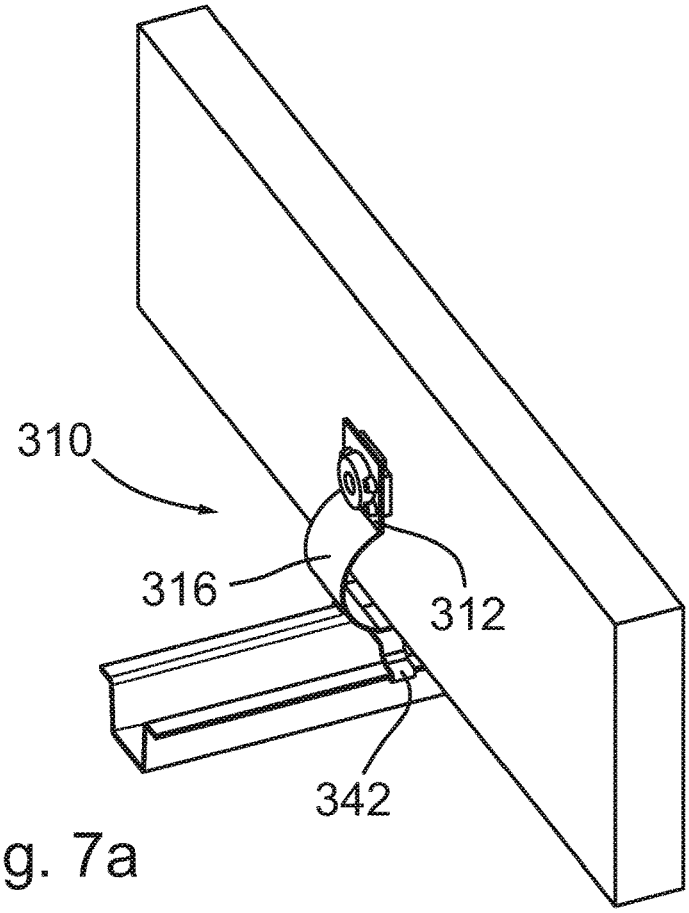
FIGS. 7*a* and 7*b* are isometric views of another embodiment of a ceiling isolation hanger secured to a ceiling joist.
Figure 7B:
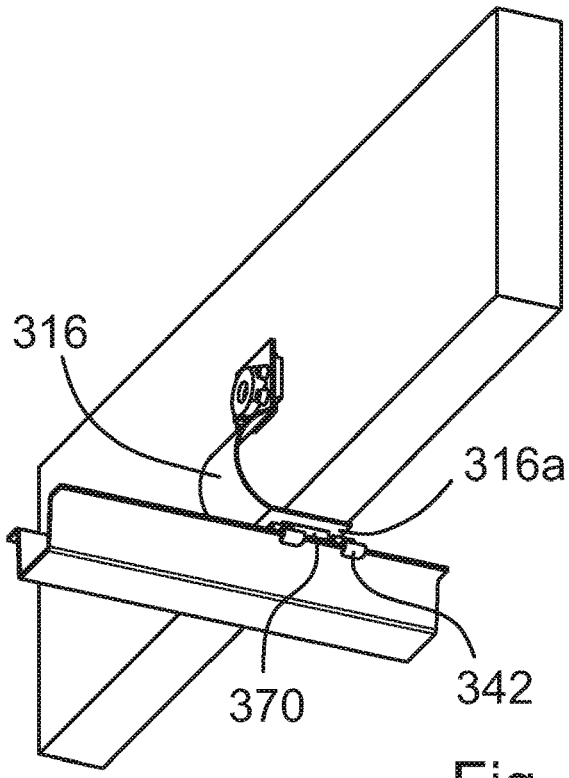

FIGS. 7*a* and 7*b* show another ceiling isolation hanger that is similar to the ceiling isolation hanger 110 of FIGS. 5*a* and 5*b* and that is generally identified by reference character 310. In this embodiment, the bracket 312 and spring element 316 are of a one-piece metal construction and have configurations similar to bracket 112 and spring element 116. A planar extension 316*a* is provided at the distal end of the spring element 316. The clip 314 of the ceiling isolation hanger 310 is of a separate metal construction and is in the form of a generally rectangular plate member. Opposite sides of the plate member are turned down and have spaced legs 342 extending therefrom that are folded under themselves to define channels configured to receive the flanges of a furring channel. Vibration dampening material 370 formed of elastomeric or viscoelastic material such as polyurethane bonded recycled rubber, polyether urethane foam or other suitable energy absorbing material is interposed between planar extension 316*a* and the clip 314 to isolate further the furring channel from vibration.

In the ceiling isolation hanger embodiments above, although the brackets are described and shown as being secured to the side surfaces of ceiling joists, those of skill in the art will appreciate that the configuration of the brackets can be altered in a manner to allow the ceiling isolation hangers to be secured to the bottom surfaces of the ceiling joists or to the undersurface of a concrete or similar ceiling.

Figure 8A:
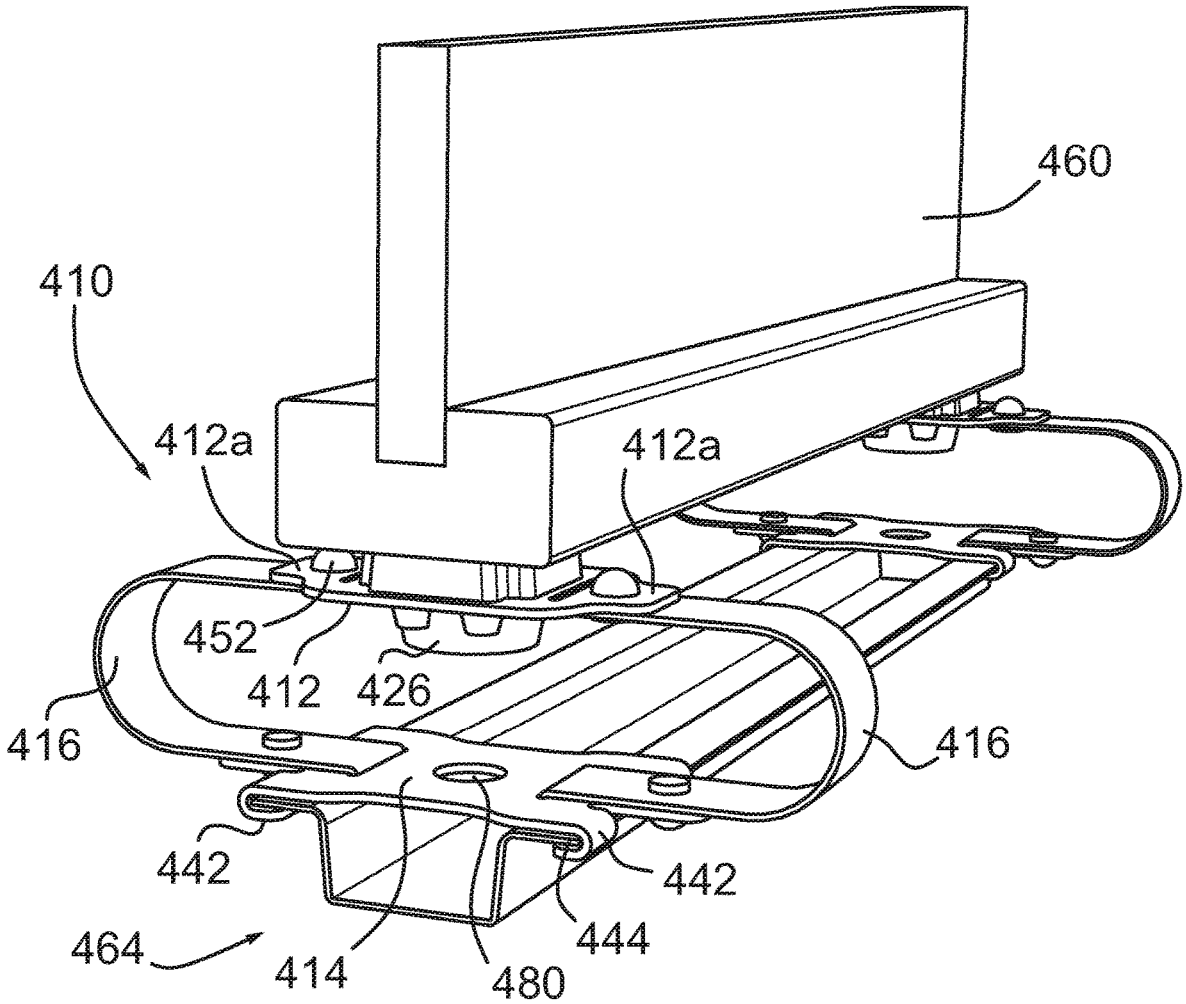
FIGS. 8*a*, 8*b* and 8*c* are isometric views of another embodiment of a ceiling isolation hanger secured to a ceiling joist.
Figure 8B:
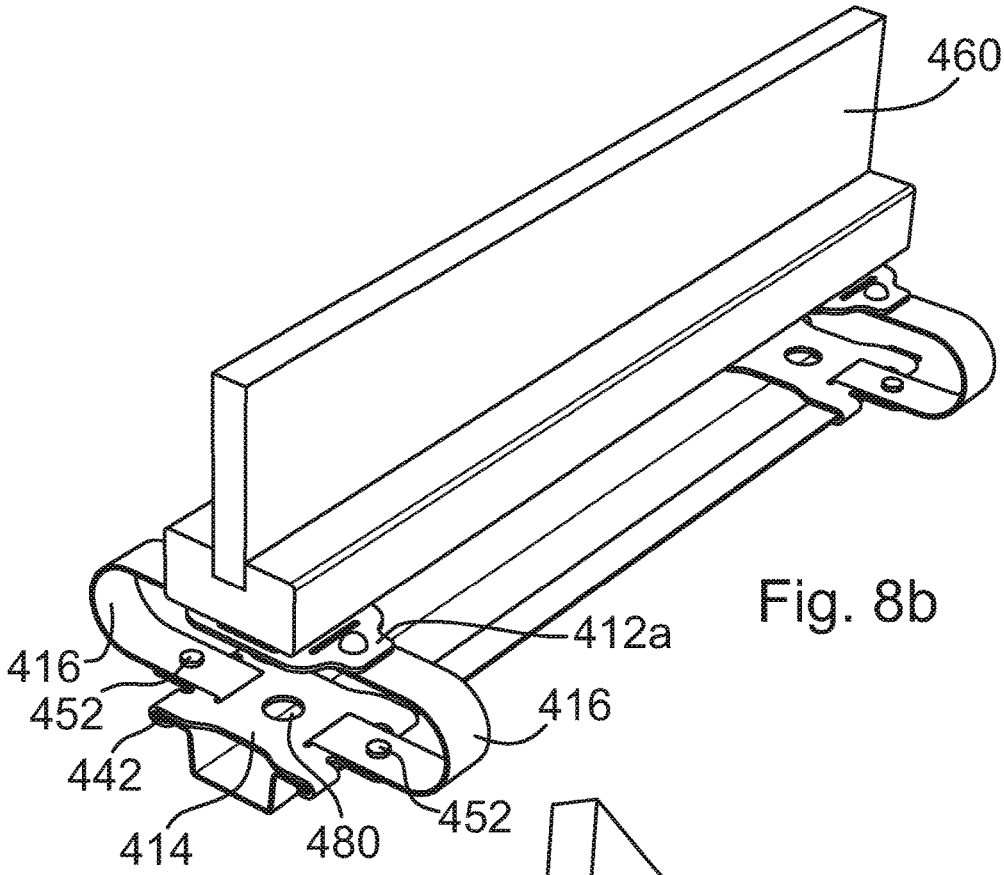
Figure 8C:
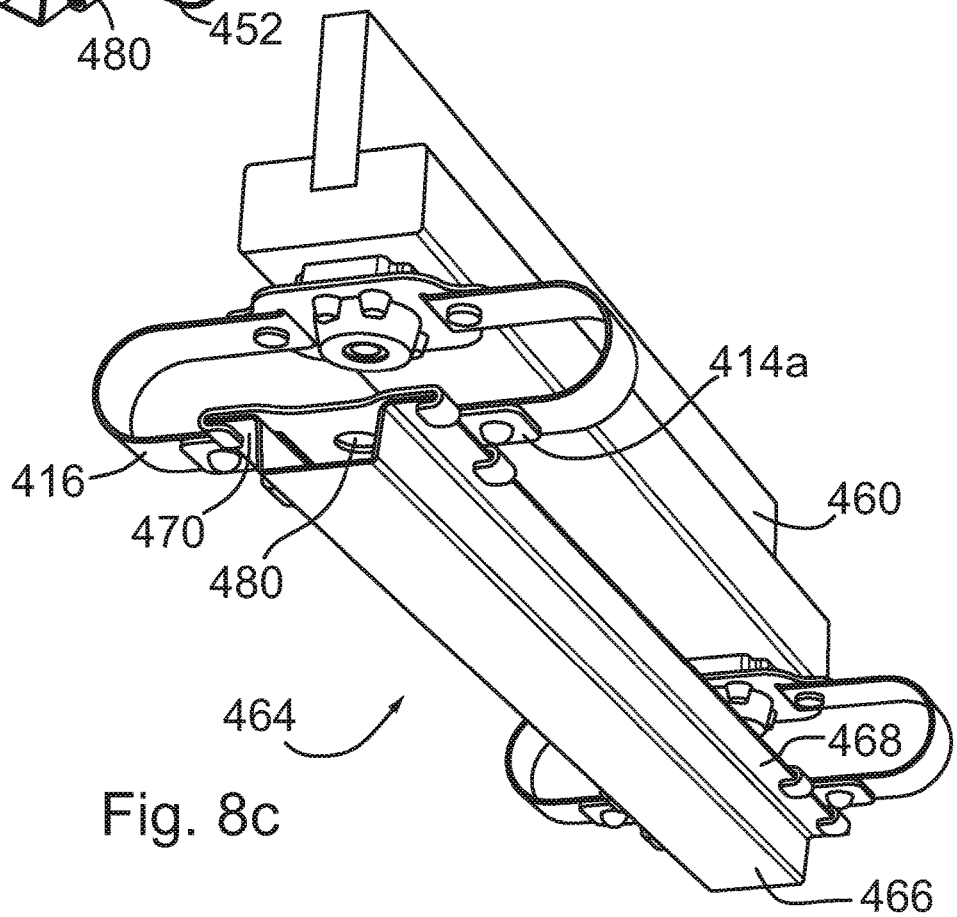

Turning now to FIGS. 8*a* to 8*c* yet another ceiling isolation hanger is shown and is generally identified by reference numeral 410. In this embodiment, the ceiling isolation hanger 410 comprises a bracket 412 configured to be secured to the bottom surface of a ceiling joist, a clip 414 configured to engage and retain a furring channel beneath the ceiling joist and a pair of spring elements 416 extending between the bracket 412 and the clip 414.

Similar to the previous embodiments, the bracket 412 is formed of metal such as steel. The bracket 412 is in the form of a generally rectangular plate member having a central aperture (not shown) provided through it. Vibration dampening material 426 similar in configuration to vibration dampening material 26 lines the aperture and extends over a portion of both major surfaces of the bracket 412. The vibration dampening material 426 is configured to retain a washer (not shown) generally in alignment with the central aperture provided in the bracket 412. Wings 412*a* extend from opposite ends of the bracket 412 and have apertures (not shown) provided therein.

The clip 414 in this embodiment is also formed of metal such as steel and is in the form of a generally rectangular plate member having laterally spaced legs 442 extending from its opposite ends. The legs 442 are folded back under themselves to define channels 444 configured to receive flanges of a furring channel. Wings 414*a* positioned between the legs 442 extend from opposite ends of the clip 414 and have apertures (not shown) provided therein. A central aperture 480 is provided in the clip 414 that is aligned with the central aperture in the bracket 412.

Each spring element 416 in this embodiment is formed of metal such as steel and has a curved configuration. Apertures (not shown) are provided in the spring elements 16 adjacent their opposite ends. Fasteners 452 in the form of rivets pass through spring element apertures and wing apertures to secure the spring elements 416 to the bracket 412 and clip 414.

During installation of the ceiling isolation hanger 410, the bracket 412 is positioned so that the vibration damping material 426 bears against the bottom surface of a ceiling joist 460. A fastener (not shown) such as a screw is then passed through the aligned apertures of the washer and bracket 412 to engage the ceiling joist 460 and secure the ceiling isolation hanger 410 to the ceiling joist. As will be appreciated, the aperture 480 provided in the clip 414 allows for the insertion of a suitable tool to facilitate access to the fastener. A standard furring channel 464 comprising a channel portion 466 and flanges 468 and 470 can then be connected to the clip 414 by inserting the flanges 468 and 470 into the channels 444 defined by the legs 442 thereby to engage and retain the furring channel 464.

In embodiments described above, although the spring elements have been described as being connected to the brackets and clips by fasteners such as rivets, those of skill in the art will appreciate that other suitable fasteners such as nuts and bolts, self-tapping screws, welds etc. may be employed to secure the spring elements to the brackets and clips. Also, although the brackets, clips and spring elements have been described as being formed of steel, those of skill in the art will appreciate that these components may be formed of other suitable types of metal or other suitable structural material.

In embodiments described above, although the vibration dampening material is described as extending over a portion of the major surfaces of the bracket, those of skill in the art will appreciate that the vibration dampening material may cover the entire bracket surfaces. Also, vibration dampening material may only be provided on the bracket surface that faces the joist surface to which the bracket is secured. Further, the vibration dampening material does not need to be configured to retain the washer through which the fastener securing the bracket to the ceiling joist passes.

Those of skill in the art will also appreciate that clips of other forms to retain the furring channel may also be used.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, and/or designed for the purpose of performing the function. It is also within the scope of the subject application that elements, components, and/or other subject matter that is described as being adapted to perform a particular function may additionally or alternatively be described as being configured to perform that function, and vice versa. Similarly, subject matter that is described as being configured to perform a particular function may additionally or alternatively be described as being operative to perform that function.

Although embodiments have been described above and are shown in the accompanying drawings, it will be appreciated by those skilled in the art that variations and modifications may be made without departing from the scope defined by the appended claims, and the scope of the claims should be given the broadest interpretation consistent with the specification as a whole.

What is claimed is:

1. A ceiling isolation hanger comprising:

a bracket configured to be secured to an overhead mounting surface, the bracket comprising vibration dampening material configured to bear against the mounting surface;

a clip spaced apart from said bracket and configured to engage and retain a furring channel such that the clip and the furring channel are suspended beneath and spaced from the mounting surface; and at least one spring element extending directly between the bracket and the clip, the at least one spring element configured to deflect to increase spacing between the bracket and the clip under ceiling load.

2. The ceiling isolation hanger of claim 1, wherein the bracket is configured to be secured to one of a side surface and a bottom surface of a ceiling joist or to an undersurface of an overhead ceiling.

3. The ceiling isolation hanger of claim 1, wherein the vibration dampening material is molded onto the bracket.

4. The ceiling isolation hanger of claim 1, wherein the vibration dampening material is formed of elastomeric or viscoelastic material.

5. The ceiling isolation hanger of claim 1, wherein the at least one spring member has one of a curved, triangular and accordion configuration.

6. The ceiling isolation hanger of claim 1, wherein the clip comprises spaced apart channels configured to receive flanges of the furring channel.

7. The ceiling isolation hanger of claim 1, wherein the bracket, the clip and the at least one spring element are formed of metal.

8. The ceiling isolation hanger of claim 1, wherein the bracket, the clip and the at least one spring element are integrally formed.

9. The ceiling isolation hanger of claim 1, wherein the at least one spring element is configured to deflect 0.1" to 1.0" under ceiling load.

10. A ceiling construction comprising:

a plurality of ceiling isolation hangers according to claim 1 secured to the overhead mounting surface at spaced locations and arranged in aligned rows;

furring channels retained by the clips of the ceiling isolation hangers of each aligned row; and ceiling panels secured to the furring channels.

11. The ceiling construction of claim 10, wherein the ceiling isolation hangers are secured to one of side surfaces and bottom surfaces of ceiling joists or to an undersurface of an overhead ceiling.

12. A ceiling isolation hanger comprising:

a securing element configured to be secured to a ceiling joist and comprising vibration dampening material to bear against a ceiling joist surface;

a furring channel retaining element spaced apart from said securing element and configured to retain and support a furring channel such that the furring channel retaining element and the furring channel are suspended beneath and spaced from the ceiling joist; and one or more spring elements extending directly between the securing element and the furring channel retaining element, the one or more spring elements configured to deflect to increase spacing between the securing element and the furring channel retaining element under ceiling load.

13. The ceiling isolation hanger of claim 12, wherein the securing element is configured to be secured to one of a side surface and a bottom surface of the ceiling joist.

14. The ceiling isolation hanger of claim 12, wherein the vibration dampening material is molded onto the securing element.

15. The ceiling isolation hanger of claim 12, wherein the vibration dampening material is formed of elastomeric or viscoelastic material.

16. The ceiling isolation hanger of claim 12, wherein the one or more spring elements have one of a curved, triangular and accordion configuration.

17. The ceiling isolation hanger of claim 12, wherein the furring channel retaining element comprises spaced apart channels configured to receive flanges of the furring channel.

18. The ceiling isolation hanger of claim 12, wherein the securing element, the furring channel retaining element and the one or more spring elements are formed of metal.

19. The ceiling isolation hanger of claim 12, wherein the securing element, the furring channel retaining element and the one or more spring elements are integrally formed.

20. A ceiling construction comprising:

a plurality of ceiling isolation hangers according to claim 12 secured to ceiling joists at spaced locations and arranged in aligned rows;

furring channels retained by the furring channel retaining elements of the ceiling isolation hangers of each aligned row; and ceiling panels secured to the furring channels.

21. The ceiling construction of claim 20, wherein the ceiling isolation hangers are secured to one of side surfaces and bottom surfaces of the ceiling joists.

22. The ceiling construction of claim 10, wherein the at least one spring element of each ceiling isolation hanger is configured to deflect 0.1" to 1.0" under load of the ceiling panels.

23. The ceiling construction of claim 20, wherein the one or more spring elements of each ceiling isolation hanger are configured to deflect 0.1" to 1.0" under load of the ceiling panels.

24. The ceiling isolation hanger of claim 1, wherein the at least one spring element comprises a single band of material having one of a curved, triangular and accordion configuration.

25. The ceiling isolation hanger of claim 24, wherein the bracket, the clip and the at least one spring element are formed of metal.

26. The ceiling isolation hanger of claim 12, wherein the one or more spring elements comprise a band of material having one of a curved, triangular and accordion configuration.

27. The ceiling isolation hanger of claim 26, wherein the bracket, the clip and the one or more spring elements are formed of metal.

* * * * *